US007594972B2

(12) United States Patent
Hasegawa et al.

(10) Patent No.: US 7,594,972 B2
(45) Date of Patent: Sep. 29, 2009

(54) ALLOY LUMP FOR R-T-B TYPE SINTERED MAGNET, PRODUCING METHOD THEREOF, AND MAGNET

(75) Inventors: Hiroshi Hasegawa, Chichibu (JP); Shiro Sasaki, Hanno (JP); Uremu Hosono, Oyama (JP); Masaaki Yui, Chichibu (JP)

(73) Assignee: Showda Denko K.K., Tokyo (JP)

( * ) Notice: Subject to any disclaimer, the term of this patent is extended or adjusted under 35 U.S.C. 154(b) by 310 days.

(21) Appl. No.: 11/547,260

(22) PCT Filed: Apr. 7, 2005

(86) PCT No.: PCT/JP2005/007190

§ 371 (c)(1),
(2), (4) Date: Oct. 4, 2006

(87) PCT Pub. No.: WO2005/098878

PCT Pub. Date: Oct. 20, 2005

(65) Prior Publication Data

US 2007/0175544 A1 Aug. 2, 2007

Related U.S. Application Data

(60) Provisional application No. 60/561,889, filed on Apr. 14, 2004.

(30) Foreign Application Priority Data

Apr. 7, 2004 (JP) ..... 2004-112810

(51) Int. Cl.
*H01F 7/02* (2006.01)
*B22D 13/00* (2006.01)

(52) U.S. Cl. ..... 148/101; 148/539; 148/302; 148/306; 148/540; 164/114; 164/115; 164/116

(58) Field of Classification Search ..... None
See application file for complete search history.

(56) References Cited

U.S. PATENT DOCUMENTS

| | | | | |
|---|---|---|---|---|
| 6,403,024 | B1 * | 6/2002 | Oota et al. | 419/33 |
| 2002/0153062 | A1 | 10/2002 | Hasegawa et al. | |
| 2003/0098094 | A1 | 5/2003 | Hasegawa et al. | |

FOREIGN PATENT DOCUMENTS

| | | | |
|---|---|---|---|
| EP | 0 886 284 | A1 | 12/1998 |
| JP | 5-222488 | A | 8/1993 |
| JP | 5-295490 | A | 11/1993 |
| JP | 8-13078 | A | 1/1996 |
| JP | 8-332557 | A | 12/1996 |
| JP | 2002-301554 | A | 10/2002 |

(Continued)

*Primary Examiner*—Melvin C Mayes
*Assistant Examiner*—Colin W Slifka
(74) *Attorney, Agent, or Firm*—Sughrue Mion, PLLC

(57) ABSTRACT

The present invention is an alloy lump for R-T-B type sintered magnets, including an $R_2T_{14}B$ columnar crystal and an R-rich phase (in which R is at least one rare earth element including Y, T is Fe or Fe with at least one transition metal element except for Fe, and B is boron or boron with carbon), in which in the as-cast state, R-rich phases nearly in the line-like or rod-like shape (the width direction of the line or rod is a short axis direction) are dispersed in the cross section, and the area percentage of the region where $R_2T_{14}B$ columnar crystal grains have a length of 500 μm or more in the long axis direction and a length of 50 μm or more in the short axis direction is 10% or more of the entire alloy.

19 Claims, 5 Drawing Sheets

FOREIGN PATENT DOCUMENTS

| | | | |
|---|---|---|---|
| JP | 2003-77717 | A | 3/2003 |
| JP | 2003-334643 | A | 11/2003 |
| WO | WO 02/18078 | A2 | 3/2002 |
| WO | WO 03/020993 | A1 | 3/2003 |

* cited by examiner

ALLOY LUMP FOR R-T-B TYPE SINTERED MAGNET, PRODUCING METHOD THEREOF, AND MAGNET

Priority is claimed on Japanese Patent Application No. 2004-112810, filed Apr. 7, 2004, and U. S. Provisional Application No. 60/561,889, filed Apr. 14, 2004, the contents of which are incorporated herein by reference.

TECHNICAL FIELD

The present invention relates to a rare earth alloy, particularly, an alloy lump for R-T-B type sintered magnets, a production method thereof, and a magnet using the alloy lump.

BACKGROUND ART

In recent years, an Nd—Fe—B type alloy as an alloy for magnets is abruptly growing in production because of its superior properties, and being used for HD (hard disk), MRI (magnetic resonant imaging) or various motors. In general, Nd (denoted as R) with a part being replaced with another rare earth element such as Pr and Dy, or Fe (denoted as T) with a part being replaced with another transition element such as Co and Ni, is usually used and these including an Nd—Fe—B type alloy are generically called an R-T-B type alloy.

The R-T-B type alloy is an alloy comprising a crystal having, as the main phase, a ferromagnetic phase $R_2T_{14}B$ contributing to the magnetization activity, where a non-magnetic, rare earth element-enriched and low-melting point R-rich phase is present at the grain boundary. This alloy is an active metal and therefore, is generally melted in vacuum or in an inert gas and then cast in a die.

The obtained alloy lump is usually ground into a powder material of about 3 μm (as measured by FSSS (Fisher sub-sieve sizer)), press-shaped in a magnetic field, sintered at a high temperature of about 1,000 to 1,100° C. in a sintering furnace and thereafter, if desired, subjected to heat treatment, machining and plating for corrosion prevention, whereby a magnet is completed.

The R-rich phase plays an important role in the following points.

1) The R-rich phase comes into a liquid phase at the sintering by virtue of its low melting point and therefore, contributes to densification of the magnet and in turn, enhancement of magnetization.

2) The R-rich phase eliminates the unevenness on the grain boundary to decrease reversed magnetic domains and enhance the coercive force.

3) The R-rich phase magnetically isolates the main phase and therefore, brings an enhanced coercive force.

As understood from these, bad dispersion of the R-rich phase adversely affects the properties of the magnet and therefore, uniform dispersion is important.

The R-rich phase distribution in a final magnet is greatly dependent on the structure of the raw material alloy lump. That is, when an alloy is cast in a die, crystal grains often grow due to the low cooling rate and therefore, the particles after grinding have a particle diameter by far smaller than the crystal grain diameter. Also, in the die casting, since R-rich phases are mostly aggregated at the grain boundary and not present within the particle, the particle containing only the main phase but not containing the R-rich phase and the particle containing only the R-rich phase are separately present and their uniform mixing becomes difficult.

As another problem in the die casting, γ-Fe is readily formed as the primary crystal due to the low cooling rate. The γ-Fe is transformed into α-Fe at about 910° C. or less and the transformed α-Fe incurs reduction in the grinding efficiency at the production of a magnet and if remains after sintering, deteriorates the magnetic properties. Therefore, in the case of an ingot cast from a die, the α-Fe must be eliminated by a homogenization treatment at a high temperature over a long period of time.

In order to solve these problems, a strip casting method (simply refereed to as an "SC method") has been proposed as a casting method of realizing a cooling rate higher than that in the die casting method and this method is being used in actual processing.

In this casting method, a molten alloy is spread on a copper roll to cast a thin belt of about 0.3 mm, thereby effecting rapid cooling and solidification, as a result, the crystal structure is made fine and the alloy chip produced has a structure where R-rich phases are finely dispersed. The fine dispersion of the R-rich phase within the alloy chip leads to good dispersibility of the R-rich phase after grinding and sintering and in turn, the magnetic properties are successfully enhanced (see, Patent Document 1 (Japanese Unexamined Patent Application, Fists Publication No. H05-222488) and Patent Document2 (Japanese Unexamined Patent Application, Fists Publication. H05-295490)). However, also in this method, α-Fe is inevitably generated as the concentration of R component decreases and, for example, in the case of an Nd—Fe—B ternary alloy, generation of α-Fe is observed when Nd is 28 mass % or less.

This α-Fe conspicuously inhibits the grinding property in the step of producing a magnet.

The present inventors have made improvements of conventional centrifugal casting methods and invented a method of disposing a reciprocating box-type tundish with a plurality of nozzles on the inner side of a rotating mold, and depositing and solidifying a molten alloy on the inner surface of the rotating mold through the tundish (centrifugal casting, hereinafter simply referred to as a "CC method"), as well as an apparatus therefor (see, Patent Document 3 (Japanese Unexamined Patent Application, Fists Publication No. H08-13078) and Patent Document 4 (Japanese Unexamined Patent Application, Fists Publication No.8-332557)).

In the CC method, a molten alloy is sequentially poured on an already deposited and solidified alloy lump and since the additionally cast molten alloy solidifies while the mold makes one rotation, the solidification rate can be elevated. However, even in this CC method, when an alloy having a low R component concentration is intended to produce, α-Fe is inevitably produced due to the low cooling rate in the high-temperature region.

In order to avoid the production of α-Fe, the present inventors have invented a centrifugal casting method of sprinkling a molten alloy from a rotating tundish and depositing it on a rotating mold, so that the depositing rate of the molten alloy can be more decreased and thereby, the solidification and cooling rate in the CC method can be elevated (new centrifugal casting, hereinafter simply referred to as an "NCC method", see Patent Document 5 (Japanese Unexamined Patent Application, Fists Publication No.2002-301554)). By this method, the generation of α-Fe is suppressed and as means for enhancing the magnetization properties of a magnet, a cast lump containing substantially no α-Fe on the low R component concentration side is obtained. Also, there has been proposed a method of depositing and solidifying a molten alloy on the inner surface of a rotating cylindrical mold with the inner surface being a convex and/or concave uneven face, so that the R-rich phase can be finely and uniformly distributed (see, Patent Document 6(Japanese Unexamined Patent Application, Fists Publication No.2003-77717)).

Furthermore, a depositing and solidifying method using a cylindrical mold has been proposed, where a film having a thermal conductivity smaller than that of the construction material of the mold is provided on the inner surface of the mold (see, Patent Document 7 (Japanese Unexamined Patent Application, Fists Publication No.2003-334643)).

DISCLOSURE OF INVENTION

In the method of Patent Document 6, despite the enhanced dispersibility of the R-rich phase, the temperature of the already deposited alloy lump elevates during the time of depositing molten alloy droplets and this causes aggregation of R-rich phases into a pool state, as a result, the R-rich phase is first ground at the fine grinding step in the process of producing a sintered magnet and there arise a problem that the time fluctuation of the obtained powder material composition is not stabilized. Furthermore, the dispersibility of the R-rich phase in the obtained powder material is poorer than that in alloy flakes produced by the SC method (hereinafter simply referred to as an "SC alloy") and therefore, the coercive force is disadvantageously rather low.

In the method of Patent Document 7, the cooling rate is increased but in turn, the particle diameter of the $R_2T_{14}B$ crystal is decreased and this causes a problem such as increase in the ratio of fine equi-axed crystal called a chill crystal.

An object in the present invention in the present invention is to provide an alloy lump for R-T-B type sintered magnets, where the R-rich phase is small and has good dispersibility and the $R_2T_{14}B$ crystal size is large.

As a result of continuous efforts for improvements in the NCC method, the present inventors have invented an alloy lump having an optimal structure as a sintered magnet with high coercive force, high orientation degree and good magnetization property, by optimizing the mold inner surface state and the molten alloy-feeding rate. That is, the present invention provides:

(1) An alloy lump for R-T-B type sintered magnets, comprising an $R_2T_{14}B$ columnar crystal and an R-rich phase (wherein R is at least one rare earth element including Y, T is Fe or Fe with at least one transition metal element except for Fe, and B is boron or boron with carbon), wherein in the as-cast state, R-rich phases nearly in the line-like or rod-like shape (the width direction of the line or rod is a short axis direction) are dispersed in the cross section, and the area percentage of the region where $R_2T_{14}B$ columnar crystal grains have a length of 500 μm or more in the long axis direction and a length of 50 μm or more in the short axis direction is 10% or more of the entire alloy.

(2) An alloy lump for R-T-B type sintered magnets, comprising an $R_2T_{14}B$ columnar crystal and an R-rich phase (wherein R is at least one rare earth element including Y, T is Fe or Fe with at least one transition metal element except for Fe, and B is boron or boron with carbon), wherein in the as-cast state, the area percentage of R-rich phases having a length of 5 μm or more in the short axis direction is 10% or less of all R-rich phases present in the alloy, and the area percentage of the region where $R_2T_{14}B$ columnar crystal grains have a length of 500 μm or more in the long axis direction and a length of 50 μm or more in the short axis direction is 10% or more of the entire alloy.

(3) An alloy lump for R-T-B type sintered magnets as described in (1) or (2) above, wherein the area percentage of R-rich phases having a length of 5 μm or more in the short axis direction is 10% or less of all R-rich phases present in the alloy, and the area percentage of the region where $R_2T_{14}B$ columnar crystal grains have a length of 1,000 μm or more in the long axis direction and a length of 50 μm or more in the short axis direction is 10% or more of the entire alloy.

(4) An alloy lump for R-T-B type sintered magnets as described any one of (1) to (3) above, wherein the area percentage of R-rich phases having a length of 5 μm or more in the short axis direction is 10% or less of all R-rich phases present in the alloy, and the area percentage of the region where $R_2T_{14}B$ columnar crystal grains have a length of 1,000 μm or more in the long axis direction and a length of 100 μm or more in the short axis direction is 10% or more of the entire alloy.

(5) An alloy lump for R-T-B type sintered magnets as described in (1) or (2) above, wherein the area percentage of R-rich phases having a length of 3 μm or more in the short axis direction is 10% or less of all R-rich phases present in the alloy, and the area percentage of the region where $R_2T_{14}B$ columnar crystal grains have a length of 500 μm or more in the long axis direction and a length of 50 μm or more in the short axis direction is 10% or more of the entire alloy.

(6) An alloy lump for R-T-B type sintered magnets as described in any one of (1) to (3) above or in (5) above, wherein the area percentage of R-rich phases having a length of 3 μm or more in the short axis direction is 10% or less of all R-rich phases present in the alloy, and the area percentage of the region where $R_2T_{14}B$ columnar crystal grains have a length of 1,000 μm or more in the long axis direction and a length of 50 μm or more in the short axis direction is 10% or more of the entire alloy.

(7) An alloy lump for R-T-B type sintered magnets as described in any one of (1) to (6) above, wherein the area percentage of R-rich phases having a length of 3 μm or more in the short axis direction is 10% or less of all R-rich phases present in the alloy, and the area percentage of the region where $R_2T_{14}B$ columnar crystal grains have a length of 1,000 μm or more in the long axis direction and a length of 100 μm or more in the short axis direction is 10% or more of the entire alloy.

(8) An alloy lump for R-T-B type sintered magnets as described in any one of (1) to (7) above, wherein the distance between R-rich phases is 10 μm or less on average.

(9) An alloy lump for R-T-B type sintered magnets as described in any one of (1) to (8) above, wherein the aspect ratio of the R-rich phase is 10 or more.

(10) An alloy lump for R-T-B type sintered magnets as described in any one of (1) to (9) above, wherein the length of the R-rich phase is from 50 to 100 μm on average.

(11) An alloy lump for R-T-B type sintered magnets as described in any one of (1) to (10) above, wherein α-Fe is substantially not present.

(12) An alloy lump for R-T-B type sintered magnets as described in any one of (1) to (11) above, wherein the thickness is 1 mm or more.

(13) A method for producing the alloy lump for R-T-B type sintered magnets described in any one of (1) to (12) above, comprising producing the alloy lump for R-T-B type sintered magnets by a centrifugal casting method of pouring a molten alloy on a rotary body, sprinkling the molten alloy by the rotation of the rotary body, and depositing and solidifying the molten alloy sprinkled on the inner surface of a cylindrical mold.

(14) A production method of an alloy lump as described in (13) above, which is a centrifugal casting method for producing the alloy lump for R-T-B type sintered magnets described in any one of (1) to (12) above, wherein the rotation axis R of the rotary body and the rotation axis L of the cylindrical mold used are not parallel.

(15) A production method of an alloy lump as described in (14) or (15) above, which is a centrifugal casting method for producing the alloy lump for R-T-B type sintered magnets described in any one of (1) to (12) above, wherein a film having a thermal conductivity smaller than that of the construction material of the cylindrical mold is provided on the inner wall surface of the mold.

(16) A producing method for an alloy lump as described in any one of (14) to (16) above, which is a method for producing the alloy lump for R-T-B type sintered magnets described in any one of (1) to (12) above, wherein the casting rate is increased at the initiation of casting and thereafter decreased.

(17) An R-T-B type sintered magnet produced by using, as a raw material, the alloy lump described in any one of (1) to (12) above.

BEST MODE FOR CARRYING OUT THE INVENTION

Figure 1:
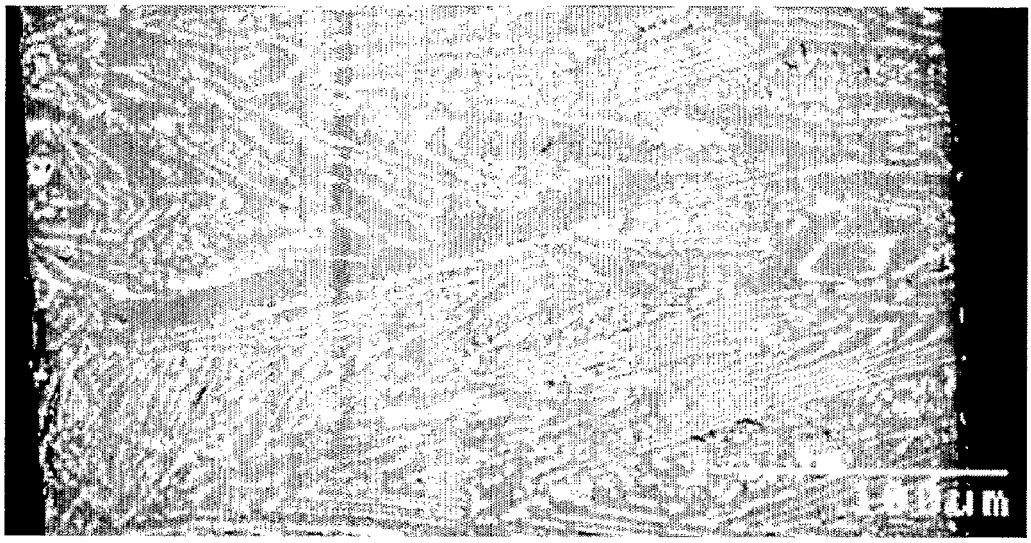
FIG. 1 is a reflection electron image by SEM showing one example of the cross-sectional structure of the alloy flake obtained by the SC method.

FIG. 1 is a reflection electron image when the cross section of, for example, an Nd—Fe—B type SC alloy (Nd: 32 mass %) is observed by SEM (scanning electron microscope). In FIG. 1, the face on the left side is a roll surface and the face on the right side is a free surface. The length from the roll face to the free face, that is, the thickness of the cast alloy flake, is 0.3 mm.

The white portion is an Nd-rich phase (since R is Nd, the R-rich phase is called an Nd-rich phase) and the shape thereof is such that some are continuously extending like a rod toward the solidification direction (from the left (roll surface side) to the right (free surface side)) and some are interspersed like dots. The longitudinal direction of the rod-like phase is extending nearly in the crystal growth direction both at the grain boundary and within the crystal grain. The melting point of the Nd-rich phase varies depending on the composition but is generally as low as from 650 to 750° C. Therefore, this phase is present as a liquid phase even after the solidification of $Nd_2Fe_{14}B$ phase and despite disappearance or division of some phases in the cooling step, the effect at the casting is remaining in the intact mode by allowing for non-uniform distribution of dot-like, line-like and rod-like phases. This shows the general cross-section structure of an R-T-B type alloy flake obtained by the SC method.

The Nd-rich phase giving a line-like or rod-like appearance in FIG. 1 is actually sheeted (lamellar). In FIG. 1, a face obtained by cutting a sheet-like Nd-rich phase in a certain direction is shown and therefore, the phase is seen as a line or a rod.

Figure 2:
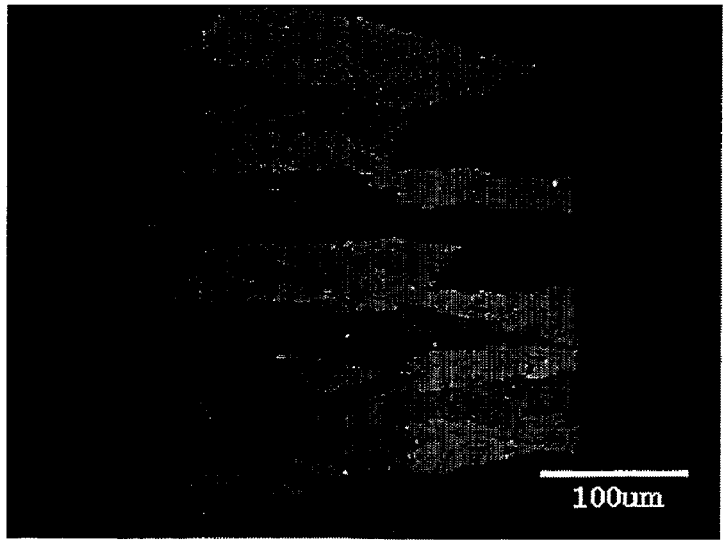
FIG. 2 is a photograph by a polarization microscope showing one example of the cross-sectional structure of the alloy flake obtained by the SC method.

FIG. 2 shows a photograph of the cross section of the above-described SC alloy, which is taken by a polarization microscope utilizing the magnetic Kerr effect. The face on the left side of the photograph is a roll surface and the face on the right side is a free surface.

An $Nd_2Fe_{14}B$ equi-axed crystal (hereinafter referred to as an "equi-axed crystal") portion in a size of approximately a few μm, which is called a chill crystal, is observed in a part near the roll surface, but the majority are an $Nd_2Fe_{14}B$ columnar crystal (hereinafter referred to as a "columnar crystal") extending in the solidification direction from the roll surface side to the free surface side. This is generally seen in the R-T-B type SC alloy and the length in the short axis direction of the columnar crystal is from 15 to 25 μm on average.

The alloy lump in the present invention is an R-T-B type (wherein R is at least one rare earth element including Y, T is Fe or Fe with a transition metal element except for Fe, and B is boron or boron with carbon). In general, R is from 28 to 35 mass % and B is from 0.8 to 1.3 mass %, with the balance being T.

Figure 3:
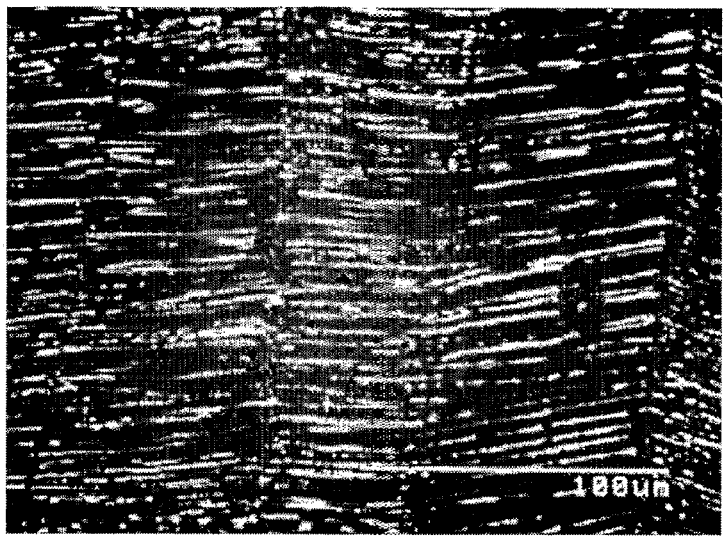
FIG. 3 is a reflection electron image by SEM showing one example of the cross-sectional structure of the alloy lump in the present invention in the present invention.

FIG. 3 is a reflection electron photograph when the cross section of the alloy lump (Nd: 32 mass %) in the present invention is observed by SEM. The magnification of FIG. 3 is the same as that of FIG. 1. Similarly to FIG. 1, a line-like or rod-like Nd-rich phase is extending from the left side to the right side of FIG. 3.

A first characteristic feature of the alloy lump in the present invention is in that, as shown in FIG. 3, most R-rich phases in the line-like or rod-like shape are uniformly dispersed, and the area percentage of the line-like or rod-like R-rich phases having an aspect ratio (length in the long axis direction/length in the short axis direction) of 10 or more, preferably 15 or more, more preferably 20 or more, still more preferably 25 or more, is 10% or more, preferably 30% or more, of all R-rich phases present in the alloy. The area percentage of all R-rich phases in the alloy varies depending on the alloy composition but is maximally about 30% and minimally about 1%. By virtue of this R-rich phase, the time fluctuation of the powder material composition at the fine grinding is stabilized, the dispersibility of the R-rich phase in the powder material is enhanced to the same level as the SC alloy, and therefore, improved sinterability and elevated coercive force result.

The Nd-rich phase giving a line-like or rod-like appearance in FIG. 3 is actually sheeted (lamellar). In the photograph, a face obtained by cutting a sheet-like Nd-rich phase in a certain direction is shown and therefore, the phase is seen as a line or a rod.

In another aspect, the characteristic feature of the alloy lump in the present invention is in that even when line-like or rod-like R-rich phases are aggregated into a size as large as 5 μm or more in terms of the length in the short axis direction, which is seen on exposing the alloy lump to a temperature higher than the melting point of the R-rich phase for a certain length of time, the area percentage of R-rich phases having a length of 5 μm or more in the short axis direction is 10% or less of all R-rich phases present in the alloy. More preferably, the area percentage of R-rich phases enlarged to have a length of 3 μm or more in the short axis direction is 10% or less of all R-rich phases present in the alloy. The aspect ratio thereof is preferably in the above-described range.

Another characteristic feature of the alloy lump in the present invention is in that, as shown in FIG. 3, the R-rich phase is broken off in the layered state every about 50 to 100 μm in a clearly visible manner. This is attributable to the production method described later and occurs because the molten alloy deposits like a sheet having a thickness of about 50 to 100 μm.

The length in the short axis direction and the area percentage of the R-rich phase are measured, for example, as follows.

Figure 5:
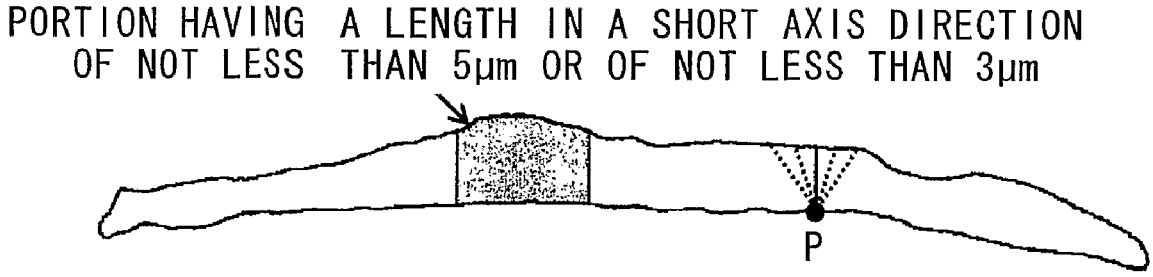
FIG. 5 is a view showing the method of image-processing the R-rich phase.

The cross section of the alloy lump is polished and arbitrary visual fields on the cross section are randomly photographed for 10 visual fields as a reflection electron image at 400 times by SEM. Each photograph is subjected to an image processing, and the area of each R-rich phase and the area of the portion where, as shown in FIG. 5, the length in the short axis direction is 3 μm or more or 5 μm or more are determined. As for the length in the short axis direction at an arbitrary point P in FIG. 5, lines are drawn from the point P as shown in FIG. 5 and a shortest line (in FIG. 5, the solid line) is defined as the length in the short axis direction.

The areas of R-rich phases in all of 10 visual fields are summed, the areas of R-rich phases in the portion where the length in the short axis direction is 3 μm or more or 5 μm or more are also summed, and the ratio between obtained numerical values is defined as the area percentage.

The area percentage may also be determined by a method of making copies of the photograph, cutting each copied paper, and measuring the weights of respective portions.

Figure 6:
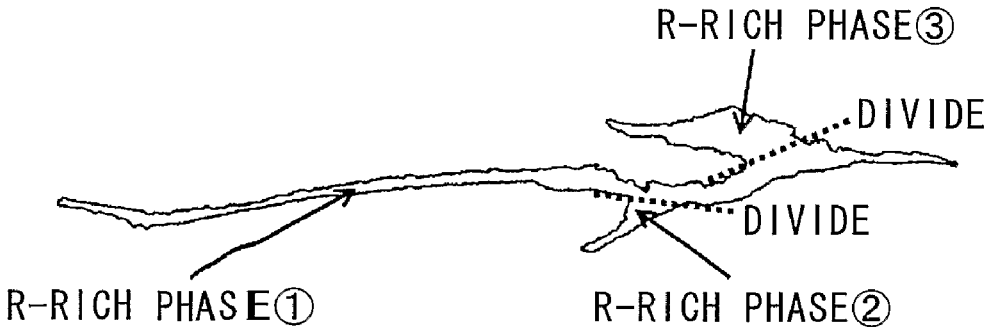
FIG. 6 is a view showing the method of image-processing the R-rich phase in a ramified shape.

In the case where the R-rich phase gives a ramified appearance as shown in FIG. 6, the branched portions are cut at respective bases (position of dotted line) and individually image-processed as separate R-rich phases.

Figure 4:
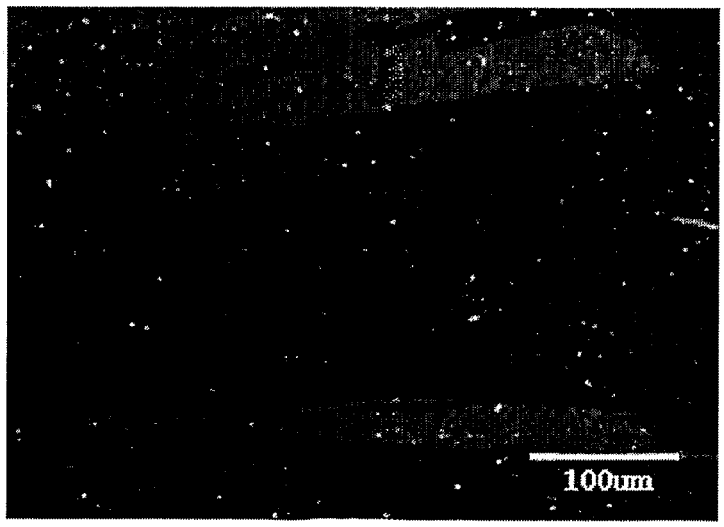
FIG. 4 is a photograph by a polarization microscope showing one example of the cross-sectional structure of the alloy lump in the present invention.

FIG. 4 shows a photograph when the cross section of the alloy lump in the present invention is photographed by a polarization microscope utilizing the magnetic Kerr effect. The magnification of FIG. 4 is the same as that of FIG. 2. The columnar crystal is extending nearly along the thickness direction and a part thereof is photographed and shown in FIG. 4.

A second characteristic feature of the alloy lump in the present invention is in that the area of each columnar crystal is larger than the area of the columnar crystal of the SC alloy shown in FIG. 2, more specifically, the area percentage of the region where the length in the long axis direction is 500 μm or more and the length in the short axis direction is 50 μm or more is 10% or more, preferably 30% or more, of the entire alloy. Preferably, the area percentage of the region where the length in the long axis direction is 1,000 μm or more and the length in the short axis direction is 50 μm or more is 10% or more, preferably 20% or more, of the entire alloy. More preferably, the area percentage of the region where the length in the long axis direction is 1,000 μm or more and the length in the short axis direction is 100 μm or more is 10% or more, preferably 20% or more, of the entire alloy. By having such an area percentage, a powder material having a crystal orientation only in one direction, which is obtained in the fine grinding step, increases and the sintered magnet produced can have a high orientation degree.

The length in the long axis direction, the length in the short axis direction and the area percentage of the crystal grain are measured, for example, as follows.

The cross section of the alloy lump is polished and at arbitrary 3 portions on the cross section, a photographic strip is taken at 50 times along the thickness direction from one end to another end of the alloy by a polarization microscope. In each photographic strip, a columnar crystal having a length of 500 μm or more or 1,000 μm or more in the long axis direction is specified. Thereafter, in each columnar crystal, the area of the portion where the length in the short axis direction is 50 μm or 100 μm or more is determined. These areas determined on photographic strips for 3 portions are divided by the total of entire cross-sectional areas on the photographic strips for 3 portions, whereby the predetermined area percentage can be obtained.

Each area may be determined by the image processing or may be determined by a method of making a copy of the photograph, cutting the copied paper, and measuring the weight of the portion.

A third characteristic feature of the alloy lump in the present invention is in that the distance between R-rich phases is 10 μm or less on average. By combining this feature with the first characteristic feature, the dispersibility of the R-rich phase after fine grinding is enhanced and the sinterability and in turn the coercive force are elevated.

The distance between R-rich phases is determined by observing the cross section of the alloy lump by SEM, and averaging the distances of R-rich phases in the direction at right angles to the cast thickness direction by the image processing or manual measurement on the photograph.

A fourth characteristic feature of the alloy lump in the present invention is in that substantially no α-Fe is generated until the R component becomes close to the stoichinometric composition. The term "substantially no α-Fe is generated" means a state in such a degree that when the presence or absence of α-Fe at arbitrary visual fields of an arbitrary cross section of the alloy lump is confirmed for 10 visual fields, α-Fe is not found in 90% or more of the visual fields. In a reflection electron image by SEM, the α-Fe gives a black dendritic appearance.

The alloy lump in the present invention can be produced by the following method. The production method is described below by referring to FIG. 7 showing one example in the present invention.

Usually, a rare earth metal is melted in a crucible 3 in a vacuum or inert gas chamber 1 because of its active property. The molten alloy 31 is lead to a rotary body 5 with a rotation axis R through a runner 6 and sprinkled on the inner wall of a cylindrical mold 4 by the rotation of the rotary body. The rotary body is a material rotating about the rotation axis R and having a function of sprinkling the poured molten alloy around the periphery and may sprinkle the molten alloy into the form of a disk, a cup with an angle at the top, a cone with an angle at the bottom or the like but, as shown in the Figure, is preferably in a container shape having a plurality of hole parts 11 on the side face (rotary receiver).

When a molten alloy is poured on such a rotary body or in the inside of a rotary body, the molten alloy is sprinkled to the periphery of the rotary body by the effect of a force induced by rotation or a centrifugal force. In this case, by decreasing the thermal capacity of the rotary body or sufficiently after-heating the rotary body, the molten alloy can be prevented from solidifying on the rotary body and can be made to deposit and solidify on the inner wall of the cylindrical mold.

Figure 7:
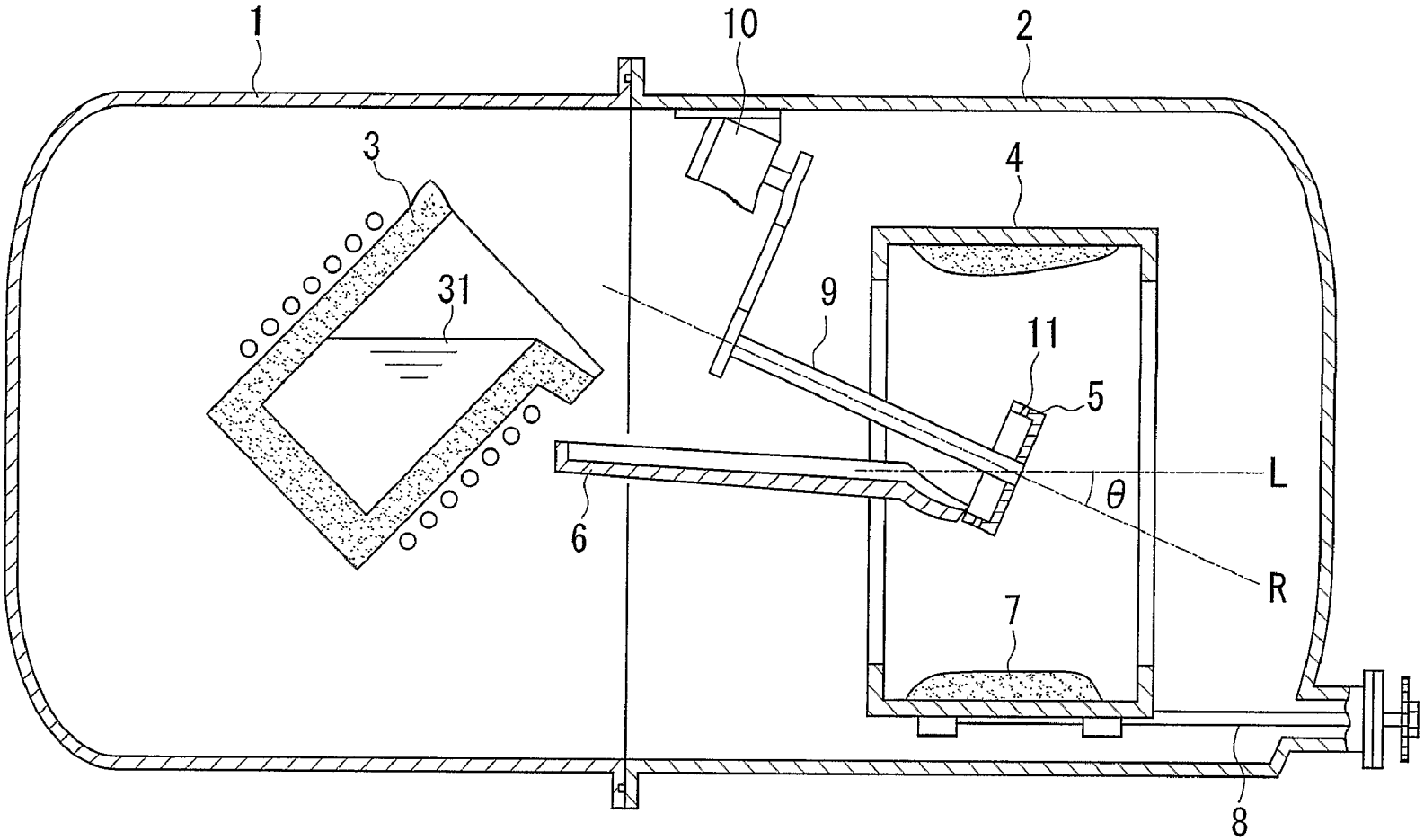
FIG. 7 is a view showing one example of the casting apparatus for use in the present invention.

The mold is placed horizontally in FIG. 7 but as long as the positional relationship with the rotary body is kept constant, the mold may be placed vertically or obliquely.

The rotation axis R of the rotary body 5 and the rotation axis L of the mold 4 may be set to run in parallel, but when these axes are set to make a certain angle θ, the deposition face can be broadened in the entire longitudinal direction of the mold and the deposition rate of the molten alloy can be thereby controlled.

By making this angle, the molten alloy can be sprinkled over a wide area range and the solidification rate can be in turn increased.

In order to sprinkle the molten alloy in the entire inside of the mold, other than the above-described method of making an angle, the same effect can also be obtained by reciprocating the mold or rotary body in the rotation axis direction of the mold.

The rotary body and the mold are preferably rotated at different rotational speeds in the same direction. If these are rotated in the counter direction, a splash phenomenon that the molten alloy when impinging on the mold is splashed without spreading on the mold readily occurs, and the yield decreases.

Also, if the rotary body and the mold are rotated at the same rotational speed, the molten alloy linearly deposits on the same face of the mold and does not spread on the entire mold face.

Accordingly, it is also not preferred that these two members are close in the rotational speed. Usually, a difference in the rotational speed of at least 10% or more, preferably 20% or more, should be present therebetween.

The rotation number of the rotary body must be selected such that the molten alloy impinges on the inner wall face of the mold by the effect of the centrifugal force of the molten alloy. Also, the rotation number of the mold is selected to generate a centrifugal force of 1 G or more for preventing the deposited and solidified alloy lump from falling off and also increase the centrifugal force largely enough to press the molten alloy against the inner wall of the mold, whereby the cooling effect can be increased.

The characteristic feature in the present invention is in that the molten alloy impinged on the inner surface of the mold is not immediately solidified but temporarily kept at a temperature higher than the liquidus temperature to crystallize the previously deposited alloy along the crystal orientation and thereafter, the deposited and integrated alloy is kept at a temperature not so much exceeding the melting point of the R-rich phase. The liquidus temperature varies depending on the R component of the molten alloy but is approximately from 1,150 to 1,300° C. The time period of keeping the impinged molten alloy at a temperature higher than the liquidus temperature is preferably from 0.001 to 1 second, more preferably from 0.001 to 0.1 second. By keeping the impinged molten alloy in this way, a columnar crystal having a large length in the short axis direction can be grown without generating γ-Fe. The melting point of the R-rich phase also varies depending on the R component but is approximately from 650 to 750° C. The temperature not so much exceeding the melting point of the R-rich phase is a temperature at most 100° C. higher than the melting point. If the temperature exceeds this range, R-rich phases aggregate to increase the length in the short axis direction and at the same μme, impair the dispersibility of the R-rich phase.

Incidentally, in FIG. 3, the R-rich phase is broken off in the layered state at intervals of about 50 to 100 μm, whereas in FIG. 4, the columnar crystal is not broken off in such a layered state. The columnar crystal can be grown without break by the above-described method in the present invention.

In order to subject the molten alloy usually at 1,300 to 1,500° C. to such changes in the temperature from the impingement on the inner surface of the mold until the completion of deposition (completion of casting), the heat transfer coefficient between the mold inner surface and the alloy should be made as large as possible. For this purpose, for example, a method of laminating a film formed of a material having a thermal conductivity lower than the construction material of the mold, on the inner surface of the mold may be used. The construction material of the film may be a metal, a ceramic or a composite material thereof. The thickness of the film is preferably from 1 μm to 1 mm, more preferably from 1 to 500 μm. By depositing a large amount of a molten alloy within several tens of seconds from the initiation of deposition (initiation of casting), the smoothness on the mold-side face of the alloy is enhanced and the thermal transfer coefficient can be made large. In other words, a film having bad thermal conductivity is laminated on the mold inner surface to lower the thermal conductivity arid thereby unsuccessfully cool the temperature of the initially deposited alloy lump and while this alloy lump having a high-temperature deformation capability, the alloy lump is tightly contacted with the mold by the effect of the centrifugal force of the mold to elevate the heat transfer coefficient between the mold and the alloy lump. At this time, in order to keep the alloy lump at a high temperature and facilitate the deformation, the deposition rate is increased (the amount of the molten alloy fed is increased). Thereafter, the deposition rate is decreased (the amount of the molten alloy fed is decreased) to allow for a sufficiently long heat transfer time to the mold and prevent the elevation of the temperature inside the alloy. Since the heat transfer takes a longer time as the thickness of the alloy is larger, the deposition rate is preferably made lower as the thickness of the alloy increases. More preferably, the deposition rate in an appropriate short time after the first deposition is made lower than the later deposition rate to give a time long enough to transfer the heat of the initially deposited alloy lump to the mold.

Also, in order to enhance the deformation capability of the initially deposited alloy lump and suppress the production of chill crystal, the inner surface of the mold may be previously heated at a temperature of 200 to 750° C. If the temperature is less than 200° C., the above-described effects cannot be expected, whereas if it exceeds 750° C., this is higher than the melting point of the R-rich phase and the temperature of the deposited alloy lump difficultly falls, as a result, R-rich phases are pooled.

The construction material of the mold is preferably a material having a thermal conductivity of 30 to 410 $Wm^{-1}K^{-1}$ at ordinary temperature. If the thermal conductivity is less than 30 $Wm^{-1}K^{-1}$, the cooling rate of the deposited alloy decreases and R-rich phases are readily pooled. On the other hand, although the thermal conductivity is preferably larger, a material having a thermal conductivity exceeding 410 $Wm^{-1}K^{-1}$ as represented by silver is expensive and such a material is not suitable for industrial use. In view of industrial use, a copper having a large thermal conductivity is preferred, but an iron may also be used without any problem.

As for the deposition rate and deposition time at the initiation of deposition and the deposition rate in the later step, optimal values must be selected based on the composition of molten alloy, the construction material of mold, the rotation axis direction of mold, the centrifugal force on the inner surface of mold, the thermal conductivity of film and the like.

The thickness of the alloy is preferably 1 mm or more. If the thickness is too small of less than 1 mm, the productivity decreases.

By grinding, shaping and sintering the alloy lump for R-T-B type magnets produced by the above-described casting method, an anisotropic magnet having superior properties can be produced.

The grinding is usually performed in the order of hydrogen cracking, intermediate grinding and fine grinding to obtain a powder material of about 3 μm (FSSS).

The hydrogen cracking is divided into a hydrogen absorption step as the pre-step and a dehydrogenation step as the post-step. In the hydrogen absorption step, hydrogen is absorbed mainly into the R-rich phase of the alloy lump in a hydrogen gas atmosphere under a pressure of 20 to 5,000 kPa and by utilizing the volume expansion of the R-rich phase due to the R-hydrogen product produced at this time, the alloy lump itself is finely divided or numerous fine cracks are generated therein. The hydrogen absorption is performed at a temperature from ordinary temperature to about 600° C., but in order to increase the volume expansion of the R-rich phase and efficiently crack the alloy lump, the hydrogen absorption is preferably performed at a temperature from ordinary temperature to about 100° C. The treating time is preferably 1 hour or more. The R-hydrogen product produced in this hydrogen absorption step is unstable and readily oxidized in air and therefore, a dehydrogenation treatment of keeping the product in vacuum of 100 Pa or less at about 200 to 600° C. is preferably performed. By this treatment, the product can be changed into an R-hydrogen product stable in air. The treating time is preferably 30 minutes or more. In the case where the atmosphere is controlled to prevent oxidation in each step from hydrogen absorption until sintering, the dehydrogenation treatment may be omitted.

Incidentally, it is also possible to perform the intermediate grinding and fine grinding without passing through the hydrogen cracking.

In the intermediate grinding, an alloy chip is ground, for example, into 500 μm or less in an inert gas atmosphere such as argon gas and nitrogen gas. Examples of the grinder therefor include a Brown mill grinder. In the case of an alloy chip subjected to hydrogen cracking in the present invention, the alloy chip is already finely divided or numerous fine cracks are generated in the inside thereof and therefore, this intermediate grinding may be omitted.

In the fine grinding, the alloy chip is ground into about 3 μm (FSSS). Examples of the grinder therefor include a jet mill. In this case, the atmosphere at the grinding is set to an inert gas atmosphere such as argon gas or nitrogen gas. In such an inert gas, oxygen in an amount of 2 mass % or less, preferably 1 mass % or less, may be mixed. By this mixing, the grinding efficiency is enhanced and at the same time, the oxygen concentration in the powder material after grinding becomes from 1,000 to 10,000 ppm to enhance the oxidation resistance. In addition, abnormal grain growth at the sintering can also be suppressed.

In order to reduce the friction between the powder material and the inner wall of the die at the magnetic field shaping or reduce the friction between powder particles to enhance the orientation degree, a lubricant such as zinc stearate is preferably added to the powder material. The amount of the lubricant added is preferably from 0.01 to 1 mass %. The lubricant may be added before or after the fine grinding but is preferably thoroughly mixed before the magnetic field shaping, in an inert gas atmosphere such as argon gas or nitrogen gas by using a V-type blender or the like.

The powder material ground into about 3 μm (FSSS) is press-shaped by a shaping machine in a magnetic field. By taking account of the magnetic field direction within the cavity, the die is produced by combining a magnetic material and a non-magnetic material. The shaping pressure is preferably from 50 to 200 MPa. The magnetic field in the cavity at the shaping is preferably from 400 to 1,600 $kAm^{-1}$. The atmosphere at the shaping is preferably an inert gas atmosphere such as argon gas or nitrogen gas, but in the case of a powder material subjected to the above-described antioxidation treatment, the shaping may be performed also in air.

The sintering is performed at 1,000 to 1,100° C., before reaching the sintering temperature. The lubricant and hydrogen in the fine powder should be removed as much as possible. The preferred condition in removing the lubricant is to hold the powder material at 300 to 500° C. for 30 minutes or more in vacuum of 1 Pa or less or in an Ar flow atmosphere under reduced pressure. The preferred condition in removing the hydrogen is to hold the powder material at 700 to 900° C. for 30 minutes or more in vacuum of 1 Pa or less. The atmosphere at the sintering is preferably an argon gas atmosphere or a vacuum atmosphere of 1 Pa or less. The holding time is preferably 1 hour or more.

After the sintering, a heat treatment at 500 to 650° C. may be applied, if desired, so as to enhance the coercive force. In the heat treatment, the atmosphere is preferably an argon gas atmosphere or a vacuum atmosphere and the holding time is preferably 30 minutes or more.

WORKING EXAMPLES

The present invention will be explained more in detail below, referring to Working Examples, however, the present invention is not limited thereto.

Working Example 1

Metallic neodymium, metallic dysprosium, ferroboron, cobalt, aluminum, copper and iron were blended to give an alloy having a composition of Nd: 27 mass %, Dy: 5 mass %, B: 1 mass %, Co: 1 mass %, Al: 0.3 mass %, and Cu: 0.1 mass % with the balance being iron. The resulting mixture was melted in an alumina crucible in an argon gas 1 atm atmosphere by using a high-frequency melting furnace, and the molten alloy was cast by an apparatus shown in FIG. 7.

The mold was made of an iron and had an inner diameter of 500 mm and a length of 500 mm, and a 80Ni-20Cr film was flame-sprayed on the inner surface of the mold.

The rotary receiver had an inner diameter of 250 mm, and eight hole parts in a diameter of 2 mm were disposed in the circumference thereof. The angle between the rotation axis of the rotary receiver and the rotation axis of the mold was set to 25°.

The rotation number of the mold was set to 104 rpm so as to give a centrifugal force of 3 G, and the rotational speed of the rotary receiver was sot to 535 rpm so as to apply a centrifugal force of about 40 G to the molten alloy.

The conditions regarding the average deposition rate of the molten alloy on the inner surface of the mold were 0.3 mm/sec for 10 seconds from the initiation of deposition, 0.2 m/sec for 10 seconds after that, and constantly 0.15 mm/sec after that until the finish.

The thickness of the obtained alloy lump was from 8 to 9 mm in the center part of the cylindrical mold and from 10 to 11 mm in the portions having a largest thickness near both end parts. The mold-side face of the alloy lump was smooth.

As for the R-rich phase of the obtained alloy lump, arbitrary visual fields were randomly photographed for 10 visual fields as a reflection electron image at 400 times by SEM (FIG. 3 shows one example thereof; in FIG. 3, the portions appearing black are pits). These photographs were image-processed, and the area percentage of the R-rich phase having a length of 5 μm or more or 3 μm or more in the short axis direction and the average distance between R-rich phases were measured.

As a result, the area percentage of 5 μm or more was 0%, the area percentage of 3 μm or more was 4%, and the average distance between R-rich phases was 5 μm.

In these 10 visual fields, the black phase considered to be α-Fe was not present.

As for the columnar crystal, a photographic strip was taken at 50 times along the thickness direction from one end to another end of the alloy at arbitrary 3 portions on the cross section by a polarization microscope (FIG. 4 is an enlarged view showing a part thereof). The area percentage of the portion where the columnar crystal had a length of 500 μm or more or 1,000 μm or more in the long axis direction and a length of 50 μm or 100 μm or more in the short axis direction was measured by the method of making a copy of the photograph on a separate sheet, cutting the copied paper, and measuring the weight of the portion.

As a result, the portion of 500 μm or more in the long axis direction and 50 μm or more in the short axis direction was 38%, and the portion of 1,000 μm or more in the long axis direction and 100 μm or more in the short axis direction was 16%.

Comparative Example 1

An alloy having the same composition as that in Working Example 1 was formulated, melted in the same manner as in Working Example 1, and cast by the same casting apparatus.

Here, however, no film was laminated on the inner surface of the mold and the conditions regarding the average deposition rate of the molten alloy on the inner surface of the mold were constantly 0.15 mm/sec from the initiation of deposition until the finish.

The thickness of the obtained alloy lump was from 8 to 9 mm in the center part of the cylindrical mold and from 10 to 11 mm in the portions having a largest thickness near both end parts. The mold-side face of the alloy lump was severely uneven and a large number of pits in a depth of several decimals of mm were present.

As for the R-rich phase of the obtained alloy lump, the area percentage of the R-rich phase having a length of 5 μm or more or 3 μm or more in the short axis direction and the average distance between R-rich phases were measured by the same method as in Working Example 1.

As a result, the area percentage of 5 μm or more was 22%, the area percentage of 3 μm or more was 41%, and the average distance between R-rich phases was 13 μm.

In these 10 visual fields, the black phase considered to be α-Fe was not present.

As for the columnar crystal, the area percentage of the portion where the columnar crystal had a length of 500 μm or more or 1,000 μm or more in the long axis direction and a length of 50 μm or 100 μm or more in the short axis direction was measured by the same method as in Working Example 1.

As a result, the portion of 500 μm or more in the long axis direction and 50 μm or more in the short axis direction was 72%, and the portion of 1,000 μm or more in the long axis direction and 100 μm or more in the short axis direction was 68%.

Comparative Example 2

Figure 8:
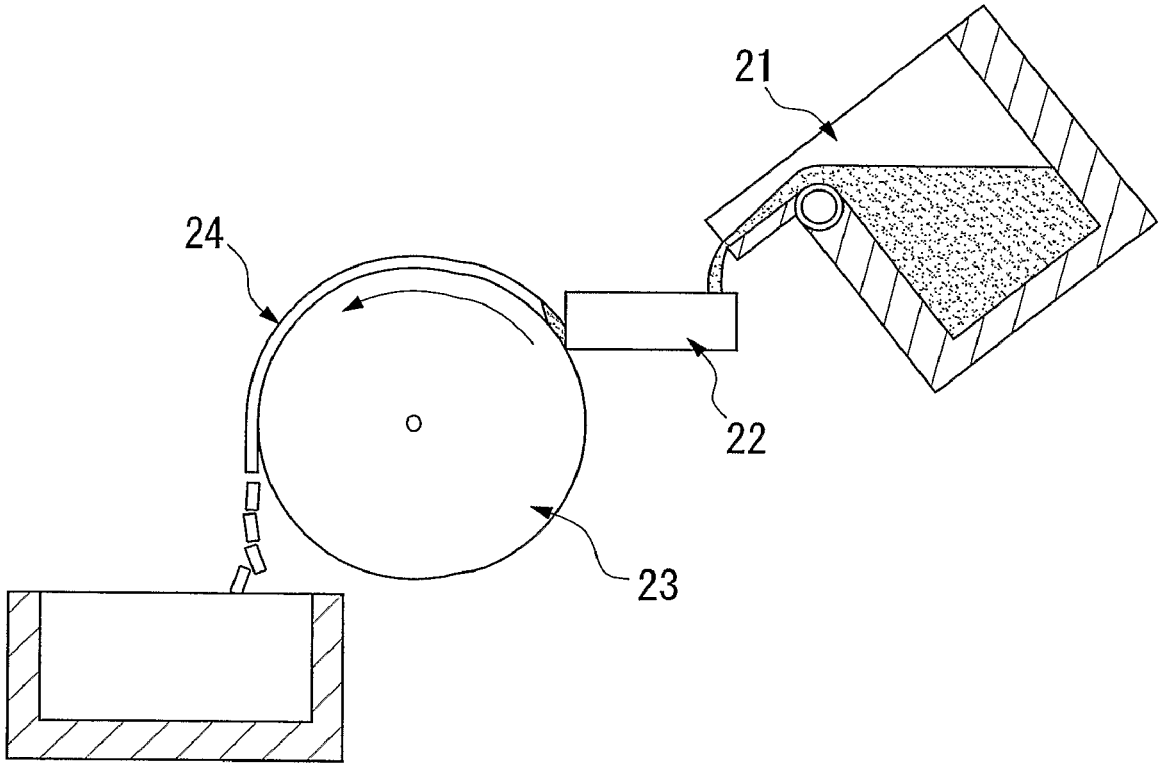
FIG. 8 is a view showing one example of the casting apparatus for use in conventional SC methods.

An alloy having the same composition as that in Working Example 1 was formulated and cast by the SC-method casting apparatus as shown in FIG. 8. The outer diameter of this water-cooled copper roll was 400 mm and at a peripheral velocity of 1 m/s, a flake-like alloy chip having an average thickness of 0.3 mm was obtained.

As for the R-rich phase of the obtained alloy flakes, the area percentage of the R-rich phase having a length of 5 μm or more or 3 μm or more in the short axis direction and the average distance between R-rich phases were measured by the same method as in Working Example 1 (FIG. 1 is one example of the reflection electron photograph by SEM; in FIG. 1, the portions appearing black are pits).

As a result, the area percentage of 5 μm or more was 2%, the area percentage of 3 μm or more was 5%, and the average distance between R-rich phases was 4.8 μm.

The maximum thickness of the SC alloy was 0.48 mm and accordingly, a columnar crystal having a length of 500 μm or more in the long axis direction was not present. FIG. 2 is one example of the polarization microphotograph showing the cross section of this alloy flake.

Examples of Magnet

Working Example 2

The alloy lump obtained in Working Example 1 was subjected to grinding in the order of hydrogen cracking, intermediate grinding and fine grinding. The conditions in the hydrogen absorption step as the post-step were 100% hydrogen atmosphere, atmospheric pressure and holding for 1 hour. The temperature of the metal lump at the initiation of hydrogen absorption reaction was 25° C. The conditions in the dehydrogenation treatment as the post-step were in-vacuum atmosphere of 10 Pa, 500° C. and holding for 1 hour. In the intermediate grinding, the powder after hydrogen cracking was ground to 425 μm or less in a 100% nitrogen atmosphere by using a Brown mill. After adding 0.07 mass % of zinc stearate powder, the resulting powder was thoroughly mixed by a V-type blender in a 100% nitrogen atmosphere and then finely ground to 3.2 μm (FSSS) by a jet mill. The atmosphere at the grinding was a nitrogen gas having mixed therein 4,000 ppm of oxygen. Thereafter, the powder was again thoroughly mixed by a V-type blender in a 100% nitrogen atmosphere. The oxygen concentration in the obtained powder material was 3,100 ppm. Also, from the analysis of the carbon concentration in this powder material, the zinc stearate powder mixed in the powder material was calculated as 0.05 mass %.

The obtained powder material was press-shaped by a shaping machine in a transverse magnetic field in a 100% nitrogen atmosphere. The shaping pressure was 118 MPa and the magnetic field in the die cavity was set to 1,200 $kAm^{-1}$.

The resulting shaped body was sintered by holding it in vacuum of $10^{-3}$ Pa at 500° C. for 1 hour, then in vacuum of $10^{-3}$ Pa at 800° C. for 2 hours, and further in vacuum of $10^{-3}$ Pa at 1,060° C. for 2 hours. The sintering density was $7.5\times10^{-3}$ $kgm^{-3}$ or more and this was a sufficiently large density. The sintered body was further heat-treated at 540° C. for 1 hour in an argon atmosphere.

The magnetic properties of this sintered body were measured by a direct current BH curve tracer and the results are shown in Table 1.

Also, the cross section of this sintered body was mirror polished and this face was observed by a polarization microscope, as a result, the crystal grain size was from 10 to 15 μm on average and nearly uniform.

Comparative Examples 3 and 4

The alloy lump obtained in Comparative Working Example 1 and the alloy flakes obtained in Comparative Example 2 each was ground by the same method as in Working Example 2 to obtain a powder material in a size of 3.2 μm (FSSS). The oxygen concentration of the powder material was 3,100 ppm. The obtained powder material was shaped in a magnetic field and sintered by the same method as in Working Example 2 to produce an anisotropic magnet.

The magnetic properties of each sintered body obtained are shown in Table 1.

The coercive force (iHc) of Working Example 2 is 185 $kAm^{-1}$ higher than that of Comparative Example 3. The reasons therefor are considered because the R-rich phase is less pooled in the alloy lump of Working Example 1, whereas in the alloy lump of Comparative Example 1, the R-rich phase is largely pooled and in turn, the dispersed state of R-rich phase is bad. On the other hand, the residual magnetic flux density (Br) of Working Example 2 is 0.027 T higher than that of Comparative Example 2 and this is congruent with 2% higher in the orientation degree. The reasons therefor are considered because the columnar crystal in the alloy lump of Working Example 1 is large but the columnar crystal in the alloy chip of Comparative Example 2 is small.

TABLE 1

| | Br, T | (iHc), $kAm^{-1}$ | (BH) max, $kJm^{-3}$ |
|---|---|---|---|
| Working Example 2 | 1.264 | 1888 | 303 |
| Comparative Example 3 | 1.266 | 1703 | 303 |

TABLE 1-continued

| | Br, T | (iHc), $kAm^{-1}$ | (BH) max, $kJm^{-3}$ |
|---|---|---|---|
| Comparative Example 4 | 1.237 | 1894 | 290 |

Working Examples 3 to 14

Metallic neodymium, metallic praseodymium, metallic dysprosium, metallic terbium, ferroboron, cobalt, aluminum, copper, ferroniobium and iron were blended so as to form an alloy composition shown in Table 2, and then the resulting mixture was melted similarly to Working Example 1, and the molten metal was cast by a similar casting apparatus. It should be noted that, as shown in Table 2, a 80 Ni-20Cr flame spraying coat, an alumina paper or an alumina flame spraying coat was formed on the inner surface of the mold. In addition, in Working Examples 3 and 5, the thickness of the alloy lump was increased by increasing the blend amount of the alloy by 43%. The mold-side face of the alloy lump obtained in each Working Examples was smooth.

[Table 2]

TABLE 2

| | COMPOSITION | | | | | | | | | | INNER SURFACE OF MOLD | |
|---|---|---|---|---|---|---|---|---|---|---|---|---|
| | Nd Mass % | Pr Mass % | Dy Mass % | Tb Mass % | B Mass % | Al Mass % | Co Mass % | Cu Mass % | Nb Mass % | Fe Mass % | COATING OR MOUNTING MATERIAL | THICKNESS μm |
| WORKING EXAMPLE 1 | 27 | | 5 | | 1 | 0.3 | 1 | 0.1 | | bal. | 80Ni—20Cr FLAME SPLAYING | 100 |
| COMPARATIVE EXAMPLE 1 | 27 | | 5 | | 1 | 0.3 | 1 | 0.1 | | bal. | NONE | |
| WORKING EXAMPLE 3 | 27 | | 5 | | 1 | 0.3 | 1 | 0.1 | | bal. | 80Ni—20Cr FLAME SPLAYING | 100 |
| WORKING EXAMPLE 4 | 27 | | 5 | | 1 | 0.3 | 1 | 0.1 | 0.5 | bal. | ALUMINA PAPER MOUNTING | 400 |
| WORKING EXAMPLE 5 | 26 | 7 | | | 1 | | | | | bal. | ALUMINA PAPER MOUNTING | 400 |
| WORKING EXAMPLE 6 | 21 | 6 | 3 | | 1 | 0.3 | 1 | 0.1 | | bal. | ALUMINA FLAME SPLAYING | 100 |
| WORKING EXAMPLE 7 | 16 | 3 | 10 | | 1 | 0.3 | 1 | 0.1 | | bal. | ALUMINA FLAME SPLAYING | 100 |
| WORKING EXAMPLE 8 | 18 | | 10 | | 1.2 | 0.3 | 1 | 0.1 | | bal. | ALUMINA FLAME SPLAYING | 100 |
| WORKING EXAMPLE 9 | 15 | 6.5 | 10 | | 1 | 0.3 | 1 | 0.1 | | bal. | ALUMINA FLAME SPLAYING | 100 |
| WORKING EXAMPLE 10 | 15 | 6.5 | | 10 | 1 | 0.3 | 1 | 0.1 | | bal. | ALUMINA FLAME SPLAYING | 100 |
| WORKING EXAMPLE 11 | 21 | 6.5 | 2.5 | 1.5 | 1 | 0.3 | 1 | 0.1 | | bal. | ALUMINA FLAME SPLAYING | 100 |
| WORKING EXAMPLE 12 | 15 | 6.5 | 5 | 5 | 1 | 0.3 | 1 | 0.1 | | bal. | ALUMINA FLAME SPLAYING | 100 |
| WORKING EXAMPLE 13 | 17.8 | 6.5 | 7.2 | | 1 | 0.3 | 1 | 0.1 | | bal. | ALUMINA FLAME SPLAYING | 100 |
| WORKING EXAMPLE 14 | 20 | 6.5 | | 5 | 1 | 0.3 | 1 | 0.1 | | bal. | ALUMINA FLAME SPLAYING | 100 |

TABLE 2-continued

| | THICKNESS OF THE ALLOY LUMP | | R-RICH PHASE | | | |
|---|---|---|---|---|---|---|
| | | | AREA PERCENTAGE | | | |
| | | | NOT LESS THAN 5 μm | NOT LESS THAN 3 μm | | |
| | CENTER PART mm | NEAR END PART mm | IN THE SHORT AXIS DIRECTION % | IN THE SHORT AXIS DIRECTION % | AVERAGE DISTANCE μm | ASPECT RATIO |
| WORKING EXAMPLE 1 | 8-9 | 10-11 | 0 | 4 | 5 | 15 |
| COMPARATIVE EXAMPLE 1 | 8-9 | 10-11 | 22 | 41 | 13 | 7 |
| WORKING EXAMPLE 3 | 11-13 | 14-16 | 2 | 6 | 5 | 13 |
| WORKING EXAMPLE 4 | 8-9 | 10-11 | 0 | 4 | 5 | 15 |
| WORKING EXAMPLE 5 | 11-13 | 14-16 | 2 | 6 | 4.7 | 18 |
| WORKING EXAMPLE 6 | 8-9 | 10-11 | 3 | 6 | 5.2 | 14 |
| WORKING EXAMPLE 7 | 8-9 | 10-11 | 4 | 8 | 5.8 | 12 |
| WORKING EXAMPLE 8 | 8-9 | 10-11 | 5 | 10 | 10 | 11 |
| WORKING EXAMPLE 9 | 8-9 | 10-11 | 0 | 4 | 4.6 | 18 |
| WORKING EXAMPLE 10 | 8-9 | 10-11 | 0 | 4 | 4.5 | 18 |
| WORKING EXAMPLE 11 | 8-9 | 10-11 | 0 | 5 | 5.1 | 15 |
| WORKING EXAMPLE 12 | 8-9 | 10-11 | 0 | 4 | 4.5 | 18 |
| WORKING EXAMPLE 13 | 8-9 | 10-11 | 0 | 4 | 4.7 | 17 |
| WORKING EXAMPLE 14 | 8-9 | 10-11 | 0 | 4 | 4.9 | 15 |

| | AREA PERCENTAGE OF THE COLUMNAR CRYSTAL | |
|---|---|---|
| | NOT LESS THAN 500 μm IN THE LONG AXIS DIRECTION AND NOT LESS THAN 50 μm IN THE SHORT AXIS DIRECTION % | NOT LESS THAN 1000 μm IN THE LONG AXIS DIRECTION AND NOT LESS THAN 100 μm IN THE SHORT AXIS DIRECTION % |
| WORKING EXAMPLE 1 | 38 | 16 |
| COMPARATIVE EXAMPLE 1 | 72 | 68 |
| WORKING EXAMPLE 3 | 42 | 21 |
| WORKING EXAMPLE 4 | 37 | 14 |
| WORKING EXAMPLE 5 | 27 | 11 |
| WORKING EXAMPLE 6 | 41 | 22 |
| WORKING EXAMPLE 7 | 47 | 29 |
| WORKING EXAMPLE 8 | 55 | 32 |
| WORKING EXAMPLE 9 | 40 | 18 |
| WORKING EXAMPLE 10 | 39 | 18 |
| WORKING EXAMPLE 11 | 39 | 17 |
| WORKING EXAMPLE 12 | 39 | 18 |
| WORKING EXAMPLE 13 | 40 | 17 |
| WORKING EXAMPLE 14 | 39 | 17 |

As for the R-rich phase of the obtained alloy lump in each of Working Examples, the area percentage of the R-rich phase having a length of 5 μm or more or 3 μm or more in the short axis direction and the average distance between R-rich phases wore measured by the same method as in Working Example 1. The results are shown in Table 2. It should be noted that substantially no phase which was thought to be α-Fe was present.

In addition, as for the columnar crystal, the area percentage of the portion where the columnar crystal had a length of 500 μm or more or 1,000 μm or more in the long axis direction and a length of 50 μm or 100 μm or more in the short axis direction was measured by the same method as in Working Example 1. The results is shown in Table 2.

Comparative Example 5

Metallic neodymium, metallic praseodymium, metallic terbium, ferroboron, cobalt, aluminum, copper, and iron were blended so as to form an alloy composition shown in Table 3, and then the resulting mixture was melted similarly to Comparative Example 2, and the molten metal was cast by a similar casting apparatus to obtain flake-like alloy chips having an average thickness of 0.3 mm.

[Table 3]

TABLE 3

| | COMPOSITION | | | | | | | | | | THICKNESS OF ALLOY FLAKE | |
|---|---|---|---|---|---|---|---|---|---|---|---|---|
| | Nd Mass % | Pr Mass % | Dy Mass % | Tb Mass % | B Mass % | Al Mass % | Co Mass % | Cu Mass % | Nb Mass % | Fe Mass % | AVERAGE mm | MAXIMUM mm |
| COMPARATIVE EXAMPLE 2 | 27 | | 5 | | 1 | 0.3 | 1 | 0.1 | | bal. | 0.3 | 0.48 |

TABLE 3-continued

| | | | | | | | | | | |
|---|---|---|---|---|---|---|---|---|---|---|
| COMPARATIVE EXAMPLE 5 | 20 | 6.5 | 5 | 1 | 0.3 | 1 | 0.1 | bal. | 0.3 | 0.49 |

| | R-RICH PHASE | | | |
|---|---|---|---|---|
| | AREA PERCENTAGE | | | |
| | NOT LESS THAN 5 μm IN THE SHORT AXIS DIRECTION % | NOT LESS THAN 3 μm IN THE SHORT AXIS DIRECTION % | AVERAGE DISTANCE μm | ASPECT RATIO |
| COMPARATIVE EXAMPLE 2 | 2 | 5 | 4.8 | 17 |
| COMPARATIVE EXAMPLE 5 | 2 | 5 | 4.9 | 17 |

| | AREA PERCENTAGE OF THE COLUMNAR CRYSTAL | |
|---|---|---|
| | NOT LESS THAN 500 μm IN THE LONG AXIS DIRECTION AND NOT LESS THAN 50 μm IN THE SHORT AXIS DIRECTION % | NOT LESS THAN 1000 μm IN THE LONG AXIS DIRECTION AND NOT LESS THAN 100 μm IN THE SHORT AXIS DIRECTION % |
| COMPARATIVE EXAMPLE 2 | 0 | 0 |
| COMPARATIVE EXAMPLE 5 | 0 | 0 |

As for the R-rich phase of the obtained alloy flake, the area percentage of the R-rich phase having a length of 5 μm or more or 3 μm or more in the short axis direction and the average distance between R-rich phases were measured by the same method as in Working Example 1. The results are shown in Table 3. It should be noted that no phase which was thought to be α-Fe was present.

On the other hand, the maximum value of thickness of the alloy chip was 0.49 mm, and hence columnar crystals having a length of not less than 500 μm in the long axis direction were not present.

Examples of Magnet

Working Example 15

The alloy lump obtained in Working Example 13 was subjected to the same grinding as in Working Example 2 to obtain a powder material having a size of 3.2 μm (FSSS). The oxygen concentration in the obtained powder material was 3,100 ppm. The obtained powder material was shaped in a magnetic field and sintered by the same method as in Working Example 2 to produce an anisotropic magnet.

The magnetic properties of this sintered body were measured by a direct current BH curve tracer and the results are shown in Table 4.

Also, the cross section of this sintered body was mirror polished and this face was observed by a polarization microscope, and as a result, the crystal grain size was from 10 to 15 μm on average and nearly uniform.

Comparative Example 6

The alloy flake obtained in Comparative Example 5 was subjected to the same grinding as in Working Example 2 to obtain a powder material having a size of 3.2 μm (FSSS). The oxygen concentration in the obtained powder material was 3,100 ppm. The obtained powder material was shaped in a magnetic field and sintered by the same method as in Working Example 2 to produce an anisotropic magnet.

The cross section of this sintered body was mirror polished and this face was observed by a polarization microscope, and as a result, the crystal grain size was from 10 to 15 μm on average and nearly uniform.

On the other hand, the magnetic properties of this sintered body were measured by a direct current BH curve tracer and the results are shown in Table 4. The magnet properties of the magnet of Comparative Example 6 which contains 5 weight % of Tb is approximately equivalent to those of the magnet of Working Example 15 which contains 7.2 weight % of Dy.

Naturally, if Tb is substituted with Dy up to a level in which the coercive force iHc might not be changed, while maintaining the total rare earth element constant, the residual magnetic flux density (Br) is decreased. However, in the magnet made of the alloy in the present invention, the orientational degree increases, and hence decreasing of the residual magnetic flux density can be prevented, even when Tb is substituted by Dy up to a level at which the coercive force might not be changed.

It should be noted that although all of Tb in Comparative Example 6 was substituted by Dy in Working Example 15, even when all of Tb cannot be substituted by Dy due to restriction of demanded performance or of production process of the magnet, a portion of Tb can be substituted by Dy. Thus, by employing the alloy in the present invention, it becomes possible to substitute all or a portion of Tb which is rare and very expensive with Dy which is considerably cheaper than Tb, thereby reducing the cost of magnets.

TABLE 4

| | Br, T | (iHc), $kAm^{-1}$ | (BH)max, $kJm^{-3}$ |
|---|---|---|---|
| Working Example 15 | 1.219 | 2266 | 282 |
| Comparative Example 6 | 1.226 | 2303 | 285 |

The alloy lump in the present invention is satisfied in both unprecedented fineness and uniformity of R-rich phase and largeness of columnar crystal, and the sintered magnet produced from this alloy lump exhibits superior characteristics, that is, high coercive force, high orientation degree and good magnetization property.

INDUSTRIAL APPLICABILITY

The alloy lump for R-T-B type sintered magnets in the present invention can be used as a magnet for magnetic hard disk, magnetic resonance imaging, various motors and the like.

The invention claimed is:

1. A cast alloy lump for R-T-B type sintered magnets, comprising an $R_2T_{14}B$ columnar crystal and an R-rich phase, wherein R is at least one rare earth element including Y, T is Fe or Fe with at least one transition metal element except for Fe, and B is boron or boron with carbon, wherein in the as-cast state, R-rich phases having a line or rod shape, with the width direction of the line or rod being a short axis direction, are dispersed in a cross section, and an area percentage of the region where $R_2T_{14}B$ columnar crystal grains have a length of 500 μm or more in a long axis direction and a length of 50 μm or more in the short axis direction is 10% or more of the entire alloy, and wherein the aspect ratio of the R-rich phase is 10 or more.

2. A cast alloy lump for R-T-B type sintered magnets as set forth in claim 1, wherein the area percentage of R-rich phases having a length of 5 μm or more in the short axis direction is 10% or less of all R-rich phases present in the alloy, and the area percentage of the region where $R_2T_{14}B$ columnar crystal grains have a length of 1,000 μm or more in the long axis direction and a length of 50 μm or more in the short axis direction is 10% or more of the entire alloy.

3. A cast alloy lump for R-T-B type sintered magnets as set forth in claim 1, wherein the area percentage of R-rich phases having a length of 5 μm or more in the short axis direction is 10% or less of all R-rich phases present in the alloy, and the area percentage of the region where $R_2T_{14}B$ columnar crystal grains have a length of 1,000, μm or more in the long axis direction and a length of 100 μm or more in the short axis direction is 10% or more of the entire alloy.

4. A cast alloy lump for R-T-B type sintered magnets as set forth in claim 1, wherein the area percentage of R-rich phases having a length of 3 μm or more in the short axis direction is 10% or less of all R-rich phases present in the alloy, and the area percentage of the region where $R_2T_{14}B$ columnar crystal grains have a length of 500 μm or more in the long axis direction and a length of 50 μm or more in the short axis direction is 10% or more of the entire alloy.

5. A cast alloy lump for R-T-B type sintered magnets as set forth in claim 1, wherein the area percentage of R-rich phases having a length of 3 μm or more in the short axis direction is 10% or less of all R-rich phases present in the alloy, and the area percentage of the region where $R_2T_{14}B$ columnar crystal grains have a length of 1,000 μm or more in the long axis direction and a length of 50 μm or more in the short axis direction is 10% or more of the entire alloy.

6. A cast alloy lump for R-T-B type sintered magnets as set forth in claim 1, wherein the area percentage of R-rich phases having a length of 3 μm or more in the short axis direction is 10% or less of all R-rich phases present in the alloy, and the area percentage of the region where $R_2T_{14}B$ columnar crystal grains have a length of 1,000 μm or more in the long axis direction and a length of 100 μm or more in the short axis direction is 10% or more of the entire alloy.

7. A cast alloy lump for R-T-B type sintered magnets as set forth in claim 1, wherein the distance between R-rich phases is 10 μm or less on average.

8. A cast alloy lump for R-T-B type sintered magnets as set forth in claim 1, wherein the length of the R-rich phase is from 50 to 100 μm on average.

9. A cast alloy lump for R-T-B type sintered magnets as set forth in claim 1, wherein αFe is substantially not present.

10. A cast alloy lump for R-T-B type sintered magnets as set forth in claim 1, wherein the thickness is 1 mm or more.

11. A method for producing the cast alloy lump for R-T-B type sintered magnets set forth in claim 1, comprising:

producing the alloy lump for R-T-B type sintered magnets by a centrifugal casting method of pouring a molten alloy on a rotary body, sprinkling the molten alloy by the rotation of the rotary body, and depositing and solidifying the molten alloy sprinkled on the inner surface of a cylindrical mold, and wherein the casting rate is increased at the initiation of casting and thereafter decreased.

12. A production method of a cast alloy lump as set forth in claim 11, which is a centrifugal casting method for producing the alloy lump for R-T-B type sintered magnets, wherein the rotation axis R of the rotary body and the rotation axis L of the cylindrical mold used are not parallel.

13. A production method of a cast alloy lump as set forth in claim 11, which is a centrifugal casting method for producing the alloy lump for R-T-B type sintered magnets, wherein a film having a thermal conductivity smaller than that of the construction material of the cylindrical mold is provided on the inner wall surface of the mold.

14. An R-T-B type sintered magnet produced by using, as a raw material, the cast alloy lump as set forth in claim 1.

15. A cast alloy lump for R-T-B type sintered magnets, comprising an $R_2T_{14}B$ columnar crystal and an R-rich phase, wherein R is at least one rare earth element including Y, T is Fe or Fe with at least one transition metal element except for Fe, and B is boron or boron with carbon, wherein in the as-cast state, the area percentage of R-rich phases having a length of 5 μm or more in the short axis direction is 10% or less of all R-rich phases present in the alloy, and the area percentage of the region where $R_2T_{14}B$ columnar crystal grains have a length of 500 μm or more in the long axis direction and a length of 50 μm or more in the short axis direction is 10% or more of the entire alloy.

16. A cast alloy lump for R-T-B type sintered magnets as set forth in claim 15, wherein the aspect ratio of the R-rich phase is 10 or more.

17. A method for producing the cast alloy lump for R-T-B type sintered magnets set forth in claim 15, comprising:

producing the alloy lump for R-T-B type sintered magnets by a centrifugal casting method of pouring a molten alloy on a rotary body, sprinkling the molten alloy by the rotation of the rotary body, and depositing and solidifying the molten alloy sprinkled on the inner surface of a cylindrical mold, wherein the rotation axis R of the rotary body and the rotation axis L of the cylindrical mold used are not parallel, and wherein the casting rate is increased at the initiation of casting and thereafter decreased.

18. A method for producing the cast alloy lump for R-T-B type sintered magnets set forth in claim 15,comprising:

producing the alloy lump for R-T-B type sintered magnets by a centrifugal casting method of pouring a molten alloy on a rotary body, sprinkling the molten alloy by the rotation of the rotary body, and depositing and solidifying the molten alloy sprinkled on the inner surface of a cylindrical mold, wherein a film having a thermal conductivity smaller than that of the construction material of the cylindrical mold is provided on the inner wall surface of the mold, and wherein the casting rate is increased at the initiation of casting and thereafter decreased.

19. A method for producing the cast alloy lump for R-T-B type sintered magnets set forth in claim 15, comprising:

producing the alloy lump for R-T-B type sintered magnets by a centrifugal casting method of pouring a molten alloy on a rotary body, sprinkling the molten alloy by the rotation of the rotary body, and depositing and solidifying the molten alloy sprinkled on the inner surface of a cylindrical mold, wherein the casting rate is increased at the initiation of casting and thereafter decreased.

* * * * *

UNITED STATES PATENT AND TRADEMARK OFFICE

CERTIFICATE OF CORRECTION

PATENT NO. : 7,594,972 B2
APPLICATION NO. : 11/547260
DATED : September 29, 2009
INVENTOR(S) : Hiroshi Hasegawa et al.

It is certified that error appears in the above-identified patent and that said Letters Patent is hereby corrected as shown below:

Title Page
Item (73) Assignee: should read: ~~Showda~~ Showa Denko K.K., Tokyo (JP)

Signed and Sealed this

Third Day of August, 2010

David J. Kappos

David J. Kappos
*Director of the United States Patent and Trademark Office*